United States Patent [19]

Heijnemans et al.

[11] 4,229,720

[45] Oct. 21, 1980

[54] DEFLECTION UNIT FOR A COLOR TELEVISION DISPLAY TUBE

[75] Inventors: Werner A. L. Heijnemans; Joris A. M. Nieuwendijk; Nicolaas G. Vink, all of Eindhoven, Netherlands

[73] Assignee: U.S. Philips Corporation, New York, N.Y.

[21] Appl. No.: 3,431

[22] Filed: Jan. 10, 1979

[30] Foreign Application Priority Data

Jan. 18, 1978 [NL] Netherlands ..... 7800585

[51] Int. Cl.[3] ..... H01F 5/00

[52] U.S. Cl. ..... 335/213; 335/210

[58] Field of Search ..... 335/210, 212, 213

[56] References Cited

U.S. PATENT DOCUMENTS

| | | | |
|---|---|---|---|
| 3,192,432 | 6/1965 | Nero | 335/213 X |
| 3,806,750 | 4/1974 | Tsuneta et al. | 313/364 |
| 4,095,202 | 6/1978 | Danielson et al. | 335/213 |
| 4,152,685 | 5/1979 | Renders et al. | 335/213 |

*Primary Examiner*—George Harris

*Attorney, Agent, or Firm*—Thomas A. Briody; William J. Streeter; Edward W. Goodman

[57] ABSTRACT

A deflection unit for a color television display tube 1 having a field deflection coil 8 and a line deflection coil 7, in which the line deflection coil is formed by two diametrically oppositely positioned coil portions which, on the side adjacent the tube's screen, have a flared end 17 having a profile with a path length 22 which is longer than the path length 23 of the contour of the outer surface of the tube, so that raster defects are smaller than when the profile of the flared ends conforms to the contour of the tube surface.

4 Claims, 6 Drawing Figures

DEFLECTION UNIT FOR A COLOR TELEVISION DISPLAY TUBE

BACKGROUND OF THE INVENTION

The invention relates to a deflection unit for a color television display tube having a neck portion, a display screen, and a flared outer surface portion therebetween, said deflection unit comprising a field deflection coil and a line deflection coil each formed by a pair of diametrically oppositely positioned coil portions, and an annular core of a magnetically permeable material surrounding at least the line deflection coil, each line deflection coil portion being in the form of a saddle coil and having conductors wound to produce first and second side members, a front end and a rear end which together define a window, with the front end forming a flange, the front end of the coil portions of said line deflection coil, when said deflection unit is mounted on a display tube, being closer to the display screen than are the rear ends, with said front ends substantially surrounding a part of the flared portion of the display tube and the flanges, lying at an angle to the longitudinal axis of said display tube.

Such a deflection unit is commonly used for deflecting the electron beams in color television display tubes. In this known unit, the two coil portions which form the field deflection coil and the two coil portions which form the line deflection coil are both adapted, as regards their shape, to the flared profile of the display tube for which the deflection unit is destined. This means that the individual conductors of the coils engage the glass of the display tube as closely as possible when the deflection unit is mounted on the display tube for which it is intended. This applies in particular to the line deflection coil, since the sensitivity of the line deflection system is an important parameter with respect to the quality of a deflection device. For that purpose it is usual to make the front ends of the coil portions of the line deflection coil arc-like in shape such that they closely follow the contour of the display tube at its flared portion. This contour is often rotationally symmetrical so that the front ends in that case are of circular shape.

More rectangular shapes of this contour are also known, involving a corresponding shape for the front end so that in that case also they optimally conform to the contour of the display tube.

Parameters, known so far which are suitable to spatially shape the magnetic field of a deflection coil of the saddle type and which fully satisfy the requirements with respect to an optimum sensitivity, are provided by the wire distribution of notably the two substantially axially extending parts of each coil portion of which parts the front end forms the connection. Known techniques for this purpose are profiling of the space in the winding mould, profiling of the press die and the insertion of pins in the mould during the winding process. Furthermore it is known that the shape of the soft-magnetic core may also be used as a parameter to some extent.

It is known that in general a color television display system may present errors which may be distinguished as coma, astigmatism, raster defects and linearity defects. For so-called "three in-line guns" display systems it has proved generally possible, by using the above-mentioned design parameters, to make deflection coils by which astigmatism defects are sufficiently minimised.

Coma can also be minimised often in a corresponding manner. The situation is different for the raster defects and the linearity defects. The raster defects are divided into the North-South and the East-West defects. In "in-line" systems the North-South raster defect produces horizontal lines at the lower and upper edges of the picture which show a slight undulating distortion, while the East-West raster defect produces a strong-pin-cushion-like distortion which may be typically between 8 and 14%. Corrections for raster defects and linearity defects are obtained in general by suitable modulations of the line and field deflection currents. In addition, static magnets may alternatively be used for the correction of the undulating distortion.

A known disadvantage of modulating deflection currents, however, is that complicated electronic deflection circuits are required, which moreover consume additional energy and hence provide an expensive solution. In addition to a higher cost-price, the disadvantage of the use of static correction magnets is that, when the correction has to be larger than a few mm, problems arise with regard to the color purity.

SUMMARY OF THE INVENTION

It is an object of the invention to provide a deflection unit and a color display tube/deflection unit combination which reduces at least one of the above distortions.

According to one aspect of the invention there is provided a deflection unit as described in the opening paragraph of this specification, characterized in that the front ends of the line deflection coil portions together define a path whose length is greater than the length of a path around the flared portion of the display tube at the part thereof which said front ends are intended to surround.

The invention also provides a color display tube in combination with a deflection unit as described above.

The invention is based on the use of a real coil design parameter by means of which the undulating distortion and the pin cushion-like East-West raster defect, respectively, can be favorably influenced, and is achieved by the shape of the front end of the line deflection coil being no longer made as short as possible, as has been usual so far. As a result of this, the resulting sensitivity of the line deflection coil is slightly less than in conventional designs having the shortest possible length of front end, but, since, compared with designs in which the defects are removed by means of modulation of the deflection currents, the modulation becomes less, the electronic deflection circuits may be simpler which results in a lower overall energy consumption than that required with line deflection coils having a minimum front end length. The simplification of the circuits and their lower overall energy consumption both result in a lower cost-price. When, for the correction of any remaining "undulation effect," a static magnet is required, a weaker magnet may be used than would otherwise be necessary. Furthermore the sensitivity loss is at a minimum if the front end is bent towards the screen over such a distance as to engage the flared part of the display tube.

When using the shape of the front end as a design parameter, it has proved particularly efficacious to shape the profile of the front end along a path which encloses a polygon. In particular if this path according to a preferred form of the deflection unit according to the invention encloses a trapezium, the frame defects as mentioned above prove to be correctable effectively. (In this case the longer of the two parallel sides of the trapezium should be deemed to be nearest to the tube axis).

DESCRIPTION OF THE DRAWING

The above and other features of the invention will now be described in greater detail, by way of example, with reference to the accompanying drawings, in which.

DESCRIPTION OF THE PREFERRED EMBODIMENT

Figure 1:
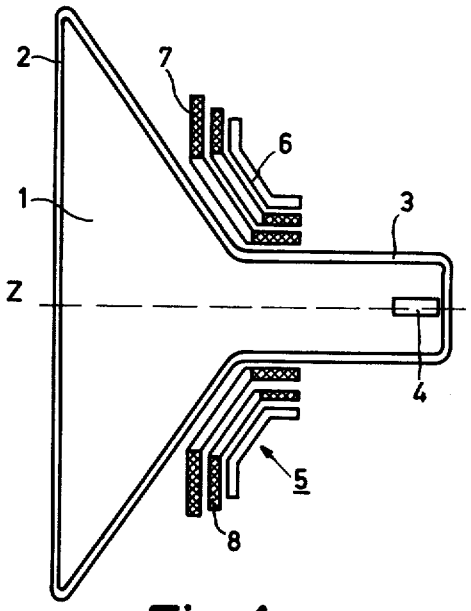
FIG. 1 is a diagrammatic longitudinal sectional view of a display tube having a deflection unit.

FIG. 1 is a longitudinal sectional view through a color television display tube 1 having a longitudinal tube axis Z, a display screen 2 and three electron guns 4 situated in one plane. An electromagnetic deflection unit 5 is mounted on the tube neck 3. The deflection unit 5 comprises a pair of saddle coils 8 which form the coil portions of the field deflection coil for the field deflection, a pair of saddle coils 7 which form the coil portions of the line deflection coil for the line deflection, and a magnet core 6 surrounding the coils in the form of a ring. The saddle coils 7 and 8 shown are of the so-called sherl type, which means that their end sections adjacent the electron guns are not situated in a plane perpendicular to the tube axis 6, as are the end sections on the screen side, but are situated in a plane parallel to the tube axis Z. However, the invention is not restricted to the use of this type of saddle coil.

Figure 2:
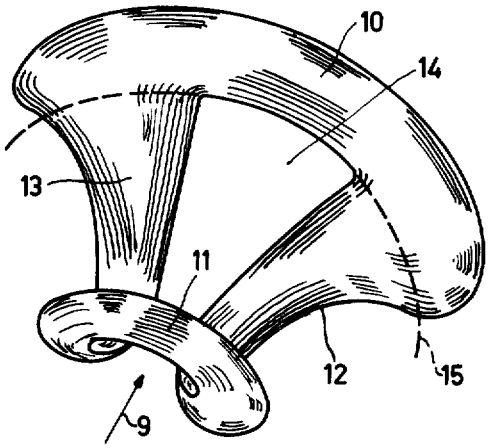
FIG. 2 shows part of a line deflection coil of a known type for use in the deflection unit shown in FIG. 3 shows diagrammatically the location of the front end of the coil shown in FIG. 2 when mounted on a display tube.
Figure 3:
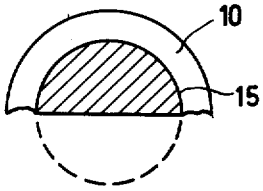

FIG. 2 shows a saddle shaped coil 9 of a conventional type having an arcuate shaped front end section 10, an arcuate shaped rear end section 11 and substantially axially extending intermediate sections 12 and 13 which sections together define a window 14. The profile of the front end section 10 follows a path 15 which is accurately adapted to the contour of the outer surface of the display tube 1 for which the coil 9 is destined. FIG. 3 which is a diagrammatic sectional view of the coil 9 at the area of the front end section 10 illustrates this. Up till now, pairs of such coils 9 have been used as the line deflection coil in conventional deflection units.

Figure 4:
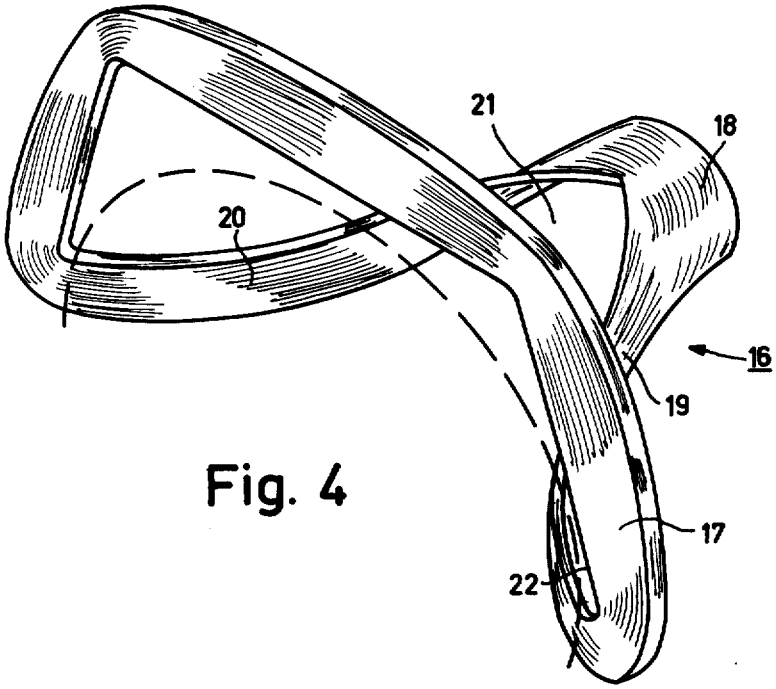
FIG. 4 shows a part of a line deflection coil for use in a deflection unit according to the invention.
Figure 5:
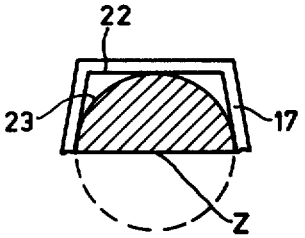
FIG. 5 shows diagrammatically the location of the front end of the coil shown in FIG. 4 when mounted on a display tube.

FIG. 4 shows a saddle shaped coil 16 which is used in a line deflection coil in a deflection unit according to the invention. The coil 16 consists of a front end section 17, a rear end section 18 and substantially axially extending conductors 19 and 20 which sections and conductors define a window 21. In this case the profile of the front end section 17 is formed along a path 22 which is longer than a path which is adapted to the contour of the outer surface of the display tube 1 for which the coil 16 is destined. All this is illustrated in FIG. 5 which is a diagrammatic sectional view of the coil 16 at the area of the front end section 17 and in which the contour of the outer surface of the display tube is denoted by 23. The path 22 in this case encloses a trapezium shaped space the longest parallel side of which faces the tube axis Z, but in general the space to be enclosed may be in the form of a polygon. In this case the rear end section 18 is shown to be horizontal, that is to say it does not lie in a plane which is at an angle to the tube axis as does the front end section 17. This coil shape is sometimes referred to as "shell" coil, but the invention is not restricted to this shape of coil.

The favorable effect of the use of this shape of the front end section 17 to correct raster defects may be considered as follows. It is known that raster defects are sensitive to variations of coil parameters on notably the screen side of the deflection unit, while the sensitivity to changes of parameters in the center of the deflection unit and on the gun side is directly reduced. However astigmatism is sensitive in particular to coil parameters in the center and on the screen side of the deflection unit and coma is influenced in particular by coil parameters on the gun side.

In coils of a "conventional" shape of the front end section where the enclosed path length is a minimum, the raster defects are produced as follows. Primarily the deflection coil is designed so that certain minimum requirements as regards astigmatism and possibly also coma are satisfied (in as far as this latter error is not corrected for by means of provisions in the display tube). This means that the coil parameters in the center of the deflection coils are controlled optimally with respect to the astigmatism. With respect to the raster defects no further parameter variations are possible and these errors are then to be taken as they present themselves following the astigmatism control.

In coils in which the shape of the front end section may be freely chosen, extra design parameters are available by which the astigmatism and also the raster defects can be influenced.

It has been found that several combinations of the coil parameters in the center of the deflection coils and of the front end section shape are possible which result in an acceptable level of astigmatism while the raster defects are always different. In this manner it is possible to find a front end shape - coil parameter combination with which the ultimate raster defects, for example, the "undulation effect" has fully disappeared or has been greatly reduced or that the pin-cushion distortion in the East-West direction has been reduced by a few percent, while it is even possible to deal with both types of errors simultaneously.

Figure 6:
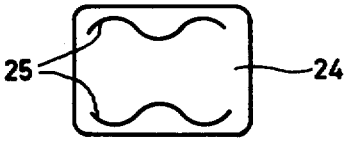
FIG. 6 shows in principle the errors to be corrected by the invention.

FIG. 6 shows diagrammatically, with reference to a display screen 24, the raster defects on the upper and lower sides of the display screen to be corrected by a deflection unit according to the invention having line deflection coils of the type shown in FIG. 4. The raster lines 25 shown have an undulating variation which is a frequently occurring shortcoming of in-line display systems. By using line coils of the type shown in FIG. 4 it was found that the raster lines were influenced so that they formed a straight line in the desired manner.

What is claimed is:

1. A deflection unit for a color television display tube having a neck portion a display screen and a partly flared outer surface portion therebetween, said deflection unit comprising a field deflection coil, a line deflection coil, each of said deflection coils being formed by a pair of diametrically oppositely positioned coil portions, and an annular core of a magnetically permeable material surrounding at least the line deflection coil, each line deflection coil portion being in the form of a saddle coil and having conductors wound to produce first and second side members, a front end and a rear end which together define a window, said front end being in the form of a flange, the front ends of the coil portions of said line deflection coil, when said deflection unit is mounted on a display tube, being closer to the display screen than are the rear ends, with said front ends substantially surrounding a part of the flared portion of the display tube and the plane of the flange-like front ends being at an angle to the longitudinal axis of said display tube, and said first and second side members extending mainly parallel to the tube axis characterized in that the front ends of the line deflection coil portions together define a path whose length is greater than the length of a path around the flared portion of the display tube at which said front ends are intended to surround.

2. A deflection unit as claimed in claim 1, characterized in that the front ends of the line deflection coil portions together define a polygon.

3. A deflection unit as claimed in claim 2, characterized in that the polygon is a hexagon.

4. The combination of a deflection unit as claimed in claim 1, 2 or 3, and a color television display tube having a neck portion, a display screen and a flared outer surface portion therebetween, said deflection unit being mounted on said display tube such that the front ends of the line deflection coil portions are closer to the display screen than are the rear ends, with the said front ends surrounding a part of the flared portion of the display tube and the flange-like front ends lying substantially at right angles to the longitudinal axis of the display tube, the path length around said flared portion of said display tube being shorter than the path length of the front ends of the line deflection coil portions surrounding said flared portion, so that defects in a raster formed on the display screen are smaller than when the said path lengths are equal.

* * * * *